US005597128A

United States Patent [19]

Terrenzio et al.

[11] Patent Number: 5,597,128

[45] Date of Patent: Jan. 28, 1997

[54] MACHINE FOR DESTRUCTURING WOOD CHIPS

[75] Inventors: Gabriel M. Terrenzio, Seattle; P. Robert Diehl, Langley; Ronald C. Oxford, Issaquah, all of Wash.

[73] Assignee: Acrowood Corporation, Everett, Wash.

[21] Appl. No.: 457,316

[22] Filed: Jun. 1, 1995

[51] Int. Cl.[6] ..... B02C 4/30

[52] U.S. Cl. ..... 241/231; 241/233; 241/234

[58] Field of Search ..... 241/224, 230, 241/231, 232, 233, 234, 236

[56] References Cited

U.S. PATENT DOCUMENTS

| | | | |
|---|---|---|---|
| 2,826,300 | 3/1958 | Ross | 241/232 |
| 3,339,233 | 9/1967 | Woitzel et al. | 241/232 X |
| 4,154,408 | 5/1979 | Boling, Jr. | 241/231 |
| 4,168,806 | 9/1979 | Jakobs | 241/232 |
| 4,953,795 | 9/1990 | Bielagus | 241/159 |
| 4,961,543 | 10/1990 | Sakato et al. | 241/266 |
| 5,253,816 | 10/1993 | Kastingschafer et al. | 241/227 |
| 5,385,309 | 1/1995 | Bielagus | 241/235 |

FOREIGN PATENT DOCUMENTS

| | | | |
|---|---|---|---|
| 2639847 | 6/1990 | France | 241/234 |
| 332186 | 1/1921 | Germany . | |
| WO82/04271 | 12/1982 | WIPO . | |
| WO89/02951 | 4/1989 | WIPO . | |
| WO90/04672 | 5/1990 | WIPO . | |

*Primary Examiner*—John M. Husar
*Attorney, Agent, or Firm*—Seed and Berry LLP

[57] ABSTRACT

A chip destructuring and fissuring machine for destructuring wood chips or the like. The chip destructuring machine includes a support frame and two swing assemblies that provide parallel side-by-side squeeze rollers are swing-mounted on the frame to swing the rollers toward about a swing axis and away from one another between active and inactive positions. A drive motor having a drive shaft with a rotational axis aligned with the swing axis is mounted to the support frame, and drive assemblies couple the drive shaft to the rollers for rotating the rollers in opposite directions at the same rotational speed. Co-acting stops are mounted on the swing assemblies and are positioned to define a spacing between the rollers when they are in the active position for squeezing and destructuring of the chips. A biasing mechanism yieldingly urges the rollers toward one another into the active position. The rollers of one embodiment include a destructuring surface defined by a plurality of criss-crossing V-shaped grooves none of which are parallel to the respective roller's axis of rotation. The criss-crossing V-shaped grooves form a plurality of diamond-shaped protuberances. The diamond-shaped protuberances on one roller being opposite a juncture area between the protuberance on the opposing roller to avoid interference between the destructuring surfaces of the opposing rollers.

24 Claims, 9 Drawing Sheets

MACHINE FOR DESTRUCTURING WOOD CHIPS

TECHNICAL FIELD

The present invention relates to destructuring over-thick wood chips to make them more suitable for pulping, and more particularly relates to chip destructuring apparatus utilizing compression rolls between which over-thick chips are passed.

BACKGROUND OF THE INVENTION

Wood chips for pulp use are usually in the range of about 12 mm to 51 mm in length, and their width is commonly about 12 mm. The grain runs lengthwise of the chips. "Acceptable" chips are normally defined as having a thickness not greater than 8 mm; hence, "over-thick" chips have been defined as these thicker than 8 mm.

In the past over-thick chips have been sliced into thinner pieces by special slicers, destructured by crushing, or split into narrower pieces. In the latter instance, breaking and splitting an over-thick chip along fissures spaced apart across the grain less than 8 mm in effect subdivides the over-thick chip into acceptable chips. This approach to converting over-thick chips to acceptable status is disclosed in U.S. Pat. No. 4,935,795 as an alternative to compressive destructuring between compression rolls having a nip clearance of about 4 or 5 millimeters. In U.S. Pat. No. 4,953,795 chip splitting is disclosed as being performed by oppositely rotating rolls having matrices of pyramid shaped projections formed by machining into the roll surface circumferential v-shaped grooves and axial v-shaped crossing the circumferential grooves at right angles. The rolls are rotatably carried by a frame in a fixed position to define a fixed spacing between the adjacent rolls. The pyramidal projections on the rolls are disclosed as preferably spaced one-half inch apart and having a height substantially equivalent to a desired chip thickness of about 6 mm. The patent mentions positioning the rolls so that the pyramids are in peak to peak orientation, or alternatively, are axially offset into a peak to valley orientation. The patent states that in the latter instance cracks are created in the chips approximately every one-fourth inch when the projections are spaced apart one-half inch and are approximately six millimeters high. This pyramid spacing and height is recommended in the patent as providing desired "aggressively contoured" roll surfaces. However, the patent does not indicate what peak-to-valley spacing between rolls gives a crack spacing of one-fourth inch.

The patent speaks of "mild treatment" and "harsh treatment". For mild treatment the spacing between the pyramid projections in the region where projections from each roll are at their closest is stated to be six millimeters, and for harsh treatment the spacing at the closest point of spacing between projections on separate rolls stated to be three millimeters. The patent does not specifically state whether these dimensions between projections are when the orientation is peak-to-peak or is peak-to-valley, but the peaks between the pyramids in each roll are one-half inch as stated in the patent, then it follows that the projections in each roll can never be closer than one-quarter inch to the projections in the other roll when the orientation is peak-to-valley. Accordingly, the mild treatment and hard treatment examples in the patent appear to be when the orientation is peak-to-peak, or else the harsh treatment to mild treatment spacing range of 3 mm. to 6 mm. is misstated and was intended to refer to the peak to valley distance at the nip with the rolls oriented in a peak to valley relationship. However, the latter arrangement would substantially crush the chips rather than splitting them particularly when the spacing is in the closer part of the spacing range.

Accordingly, U.S. Pat. No. 4,953,795 provides at least one of two oppositely rotating rolls with projections which are aggressively contoured to split over-thick chips in the thickness direction. U.S. Pat. No. 4,953,795 teaches that this is preferred to crushing and destructuring the over-thick chips. The arrangement of the projections in U.S. Pat. No. 4,953,795 is such that normally only the chips approached the nip between the rolls with the chip grain perpendicular to the plane defined by the two roll axes, can be split along the grain in the manner described in the patent. Thus, a relatively large percentage of the chips are not properly oriented for splitting when they pass between the rolls.

SUMMARY OF THE INVENTION

The present invention provides a machine for destructuring wood chips by compressing the chips and creating fissures in the chips which increases the surface area of the chips. A preferred embodiment of the invention has a support frame that provides a swing axis, and two swing assemblies that provide parallel side-by-side squeeze rollers. The swing assemblies are pivotally mounted on the frame so as to swing the rollers toward and away from one another about the swing axis between active and inactive positions. A drive motor drives the rollers, and a drive shaft of the motor rotates about an axis that is aligned with the swing axis. Drive assemblies couple the drive shaft to the rollers for rotating the rollers in opposite directions at the same rotational speed. Co-acting stops are provided on the swing assemblies, and the stops define the spacing between the rollers when the rollers are in the active squeezing position. A biasing mechanism yieldingly urges the rollers toward one another into the active position with the stops in engagement with one another.

Each of the rollers presents on its surface a pattern of diamond-shaped projections formed by criss-crossing V-shaped grooves that run helically around the rollers such that none of the V-shaped grooves are parallel with the axis of rotation of the respective roller. The diamond-shaped projections are shaped and sized for compressing and fissuring the chips rather than splitting or cracking the chips as is taught by U.S. Pat. No. 4,953,375.

In the preferred embodiment, the chip processing machine includes gear reducers mounted to the swing assemblies. Each gear reducer has an output shaft connected to the respective roller, and the gear reducers are each connected to the drive shaft of the drive motor, such that the rollers are driven in unison and in opposite directions. Each of the swing assemblies of the preferred embodiment include a pair of swing arms pivotally carried by a frame for pivotal movement about the swing axis with the roller extending between the swing arms. The rollers are movable relative to the frame about the swing axis and are rotatable relative to the swing arms. Each of the rollers is positioned a preselected distance apart defining a nip through which the chips to be destructured are passed. The size of the nip between the rollers is adjustable to accommodate a range of chips having different thicknesses.

DETAILED DESCRIPTION OF THE INVENTION

Figure 1:
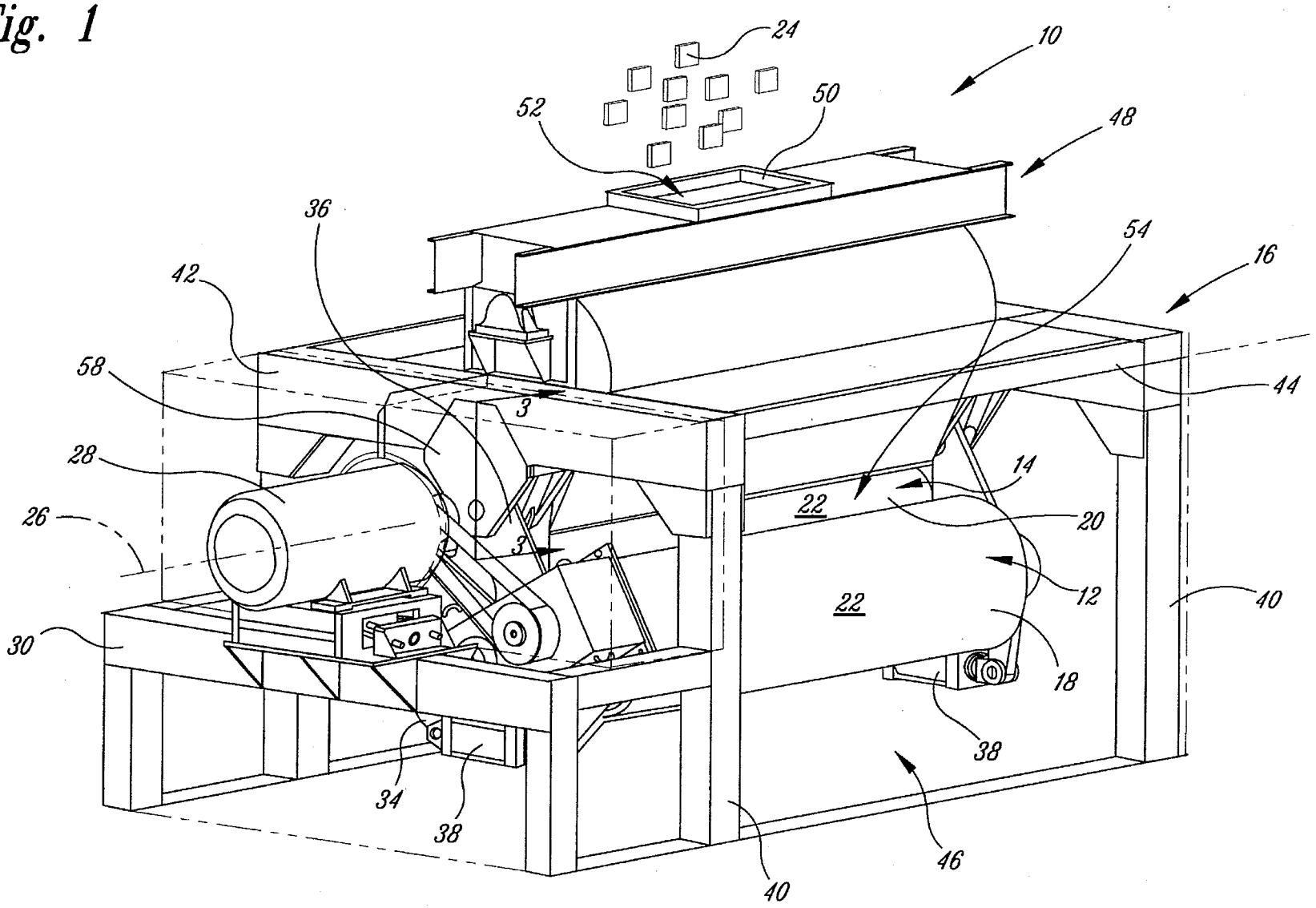
FIG. 1 is an isometric view of a wood chip destructuring machine in accordance with the present invention.

A chip processing machine 10 in accordance with the present invention, illustrated in FIG. 1, has two swing assemblies 12 and 14 that are pivotally carried by a support frame 16 and that provide parallel, side-by-side squeeze rollers 18 and 20 having outer destructuring surfaces 22. The rollers 18 and 20 are adapted to receive and squeeze chips 24 passing between the destructuring surfaces 22 of the rollers to create fissures in the chips, thereby destructuring the chips. The swing assemblies 12 and 14 are swing mounted on the frame 16 about a common swing axis 26 such that the rollers 18 and 20 are adjustably spaced apart and the rollers can swing toward and away from one another on the swing axis 26 between active and inactive positions. In the active position, the rollers 18 and 20 are spaced apart from each other at a predetermined distance and the space therebetween is a minimum separation distance that is smaller than the widths of the chips so as to compress the chips 24 passing between the destructuring outer surfaces 22 of the rollers and to create the fissures in the chip. The fissures are created in the chip 24, without breaking the chip, to maximize the effective surface area of the chip. The increased surface area in the destructured chip 24 is highly beneficial, for example, when the chips are put in a chemical bath during a pulping process or the like.

The rollers 18 and 20 of the swing assemblies 12 and 14 coupled to a drive motor 28 of the chip processing machine 10 that drives both of the rollers at the same rotational speed and in opposite directions. The drive motor 28 is supported by an outward extension 30 of the support frame 16 and is positioned such that its drive shaft 32 is aligned with the swing axis 26 of the swing assemblies 12 and 14. Accordingly, the rotational speed of the rollers 18 and 20 is not detrimentally affected by the motion of the swing assemblies 12 and 14 about the swing axis 26. The swing assemblies 12 and 14 each include a swing arm 34 and 36 that are pivotally attached to opposite ends of the frame 16 and that rotatably carry, the respective roller 18 and 20 in a horizontal orientation. The swing arms 34 and 36 of the swing assembly 12 are connected at their bottom ends to the adjacent swing arm of the other swing assembly 14 by roller pressure cylinders 38 that provide a biasing mechanism to yieldingly urge the rollers 18 and 20 toward one another into the active position during operation of the chip processing machine 10. When the biasing force of the roller pressure cylinders 38 and the force of gravity on the swing assemblies 12 and 14 are overcome, for example, during a chip destructuring process, the swing arms 34 and 36 pivot relative to the support frame 16 about the swing axis 26 and temporarily move away from the active position. When the biasing force of the roller pressure cylinders 38 in combination with the gravitational force exceeds the force pressing the rollers 18 and 20 away from the active position, the rollers return to the active position.

As best seen in FIG. 1, the swing assemblies 12 and 14 are securely carried by the support frame 16. The support frame 16 is a structurally sound frame that includes a plurality of vertical support legs 40 interconnected by a pair of parallel beams 42 and a pair of cross braces 44 extending between the beams. The support legs 40, beams 42, and cross braces 44 define an interior area 46 that contains the swing assemblies 12 and 14 and allows the swing assemblies to move between the active and inactive positions. A chute assembly 48 extends between the horizontal beams 42 and is securely connected at its ends to the horizontal beams. The chute assembly 48 has a chute 50 directly above the rollers 18 and 20 such that chips 24 entering the chute 50 through a top opening 52 are directed downwardly toward the two rollers. Accordingly, the chips 24 pass through the chute 50 and fall into a receiving area 54 defined by the two rollers 18 and 20, and the destructuring outer surfaces 22 of the two oppositely rotating rollers grab the chips and force them downwardly through the nip area, thereby creating multiple fissures in the chips.

Figure 2:
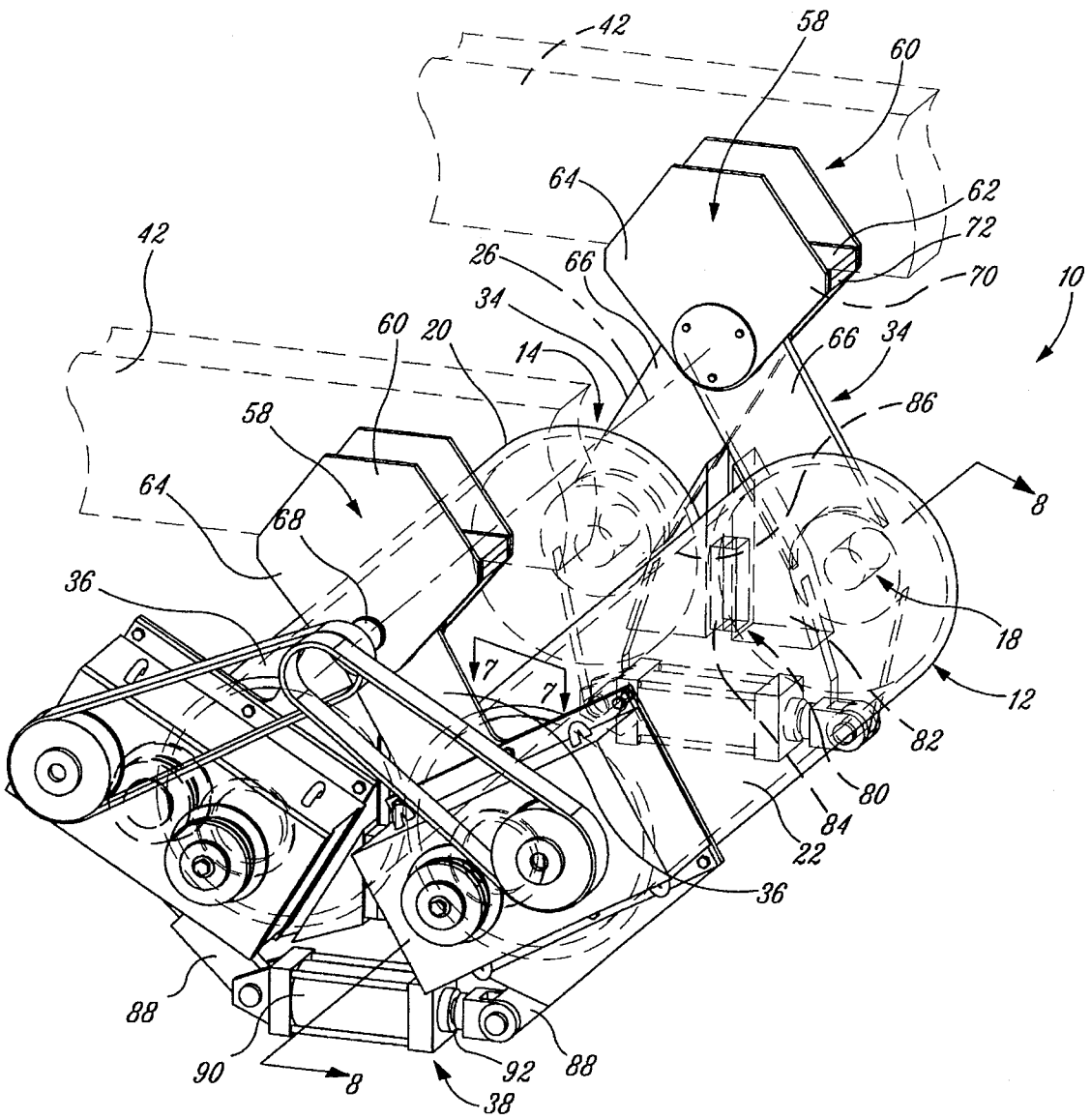
FIG. 2 is an enlarged isometric view of the destructuring machine of FIG. 1 with a portion of the frame shown in phantom lines and the drive motor not illustrated for purposes of clarity.
Figure 3:
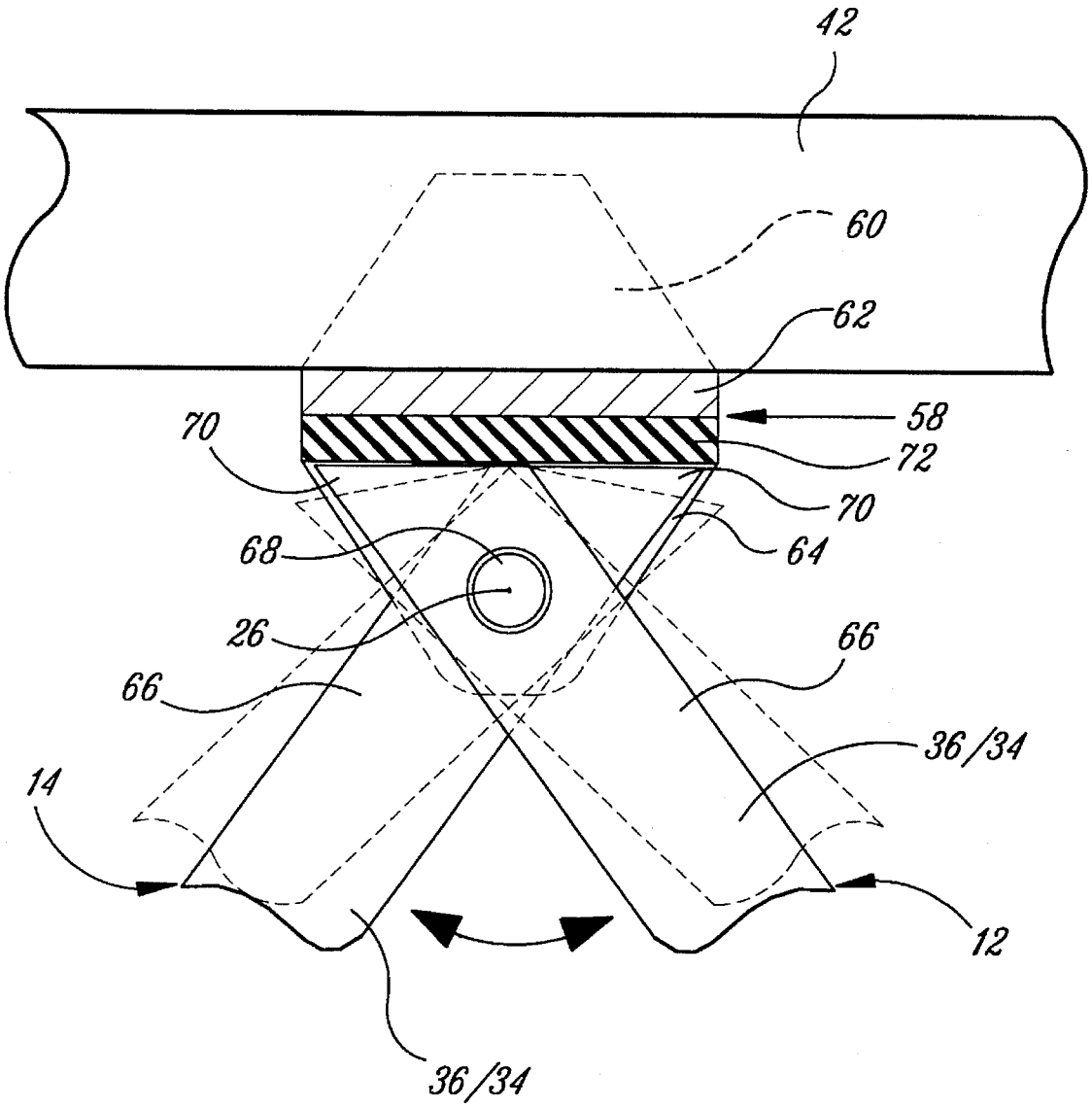
FIG. 3 is an enlarged cross-sectional view taken substantially along line 3—3 of FIG. 1 illustrating the pivotal mounting of the swing assemblies on the frame structure, with the swing arms being shown in solid lines in an active position and shown in phantom lines in an inactive position.

Each of the beams 42 has a mounting bracket 58 at approximately the center line of the chip processing machine 10. Each mounting bracket 58 pivotally carries one end of each swing assembly 12 and 14, such that the rollers 18 and 20 are in a substantially horizontal orientation below the chute 50. As best seen in FIGS. 2 and 3, each of the mounting brackets 58 includes a pair of upwardly extending flanges 60 spaced apart to receive the beam 42. The upper flanges 60 are welded to the beam 42 to rigidly secure the mounting bracket in place. A web 62 extends between the upper flanges 60 and is positioned against the bottom of the beam 42. A pair of lower flanges 64 extend downwardly from the web 62 and are spaced apart to receive the two upper portions 66 of the adjacent swing arms 34 and 36 of the swing assemblies 12 and 14. A pivot pin 68 extends through the lower flanges 64 and through the upper portions 66 of the adjacent swing arms 34 or 36. The pivot pins 68 of each of the mounting brackets 58 are coaxially aligned and define the swing axis 26 about which the swing arms 34 and 36, and thus the swing assemblies 12 and 14 pivot. The upper portions 66 of the adjacent swing arms 34 and 36 overlap and cross each other between the lower flanges 64. Accordingly, the adjacent swing arms 34 and 36 move through a scissoring motion with respect to the mounting bracket 58 as the swing assemblies 12 and 14 pivot about the pivot pins 68 and the swing axis 26 between the active position, illustrated in solid lines, and the inactive position, illustrated in phantom lines.

As best seen in FIG. 3, when the swing assemblies 12 and 14 move between the active and inactive positions and the pairs of swing arms 34 and 36 are scissored, the uppermost ends 70 of each of the swing arms move relative to the web 62 of the mounting bracket 58. Each bracket has an elastic pad 72 secured to the bottom side of the web 62 and above the upper ends 70 of the adjacent swing arms 34 and 36 to provide shock attenuation and lateral stability to the swing arms when moved to the active position. When the swing assemblies 12 and 14 are in the inactive position, the upper ends 70 of the adjacent swing arms 34 and 36 are moved downwardly away from the elastic pad 72. When the swing assemblies 12 and 14 are moved toward the active position, the upper ends 70 of the swing arms 34 and 36 move upwardly as the swing arms scissor and the upper ends press against and compress the elastic pad 72 until the swing arms reach the active position. Accordingly, the upper ends 70 of the swing arms 34 and 36 work with the elastic pads 72 to control movement and minimize shock loads on the chip processing machine when the swing assemblies 12 and 14 move away from and return to the active position during a destructuring operation.

Figure 4:
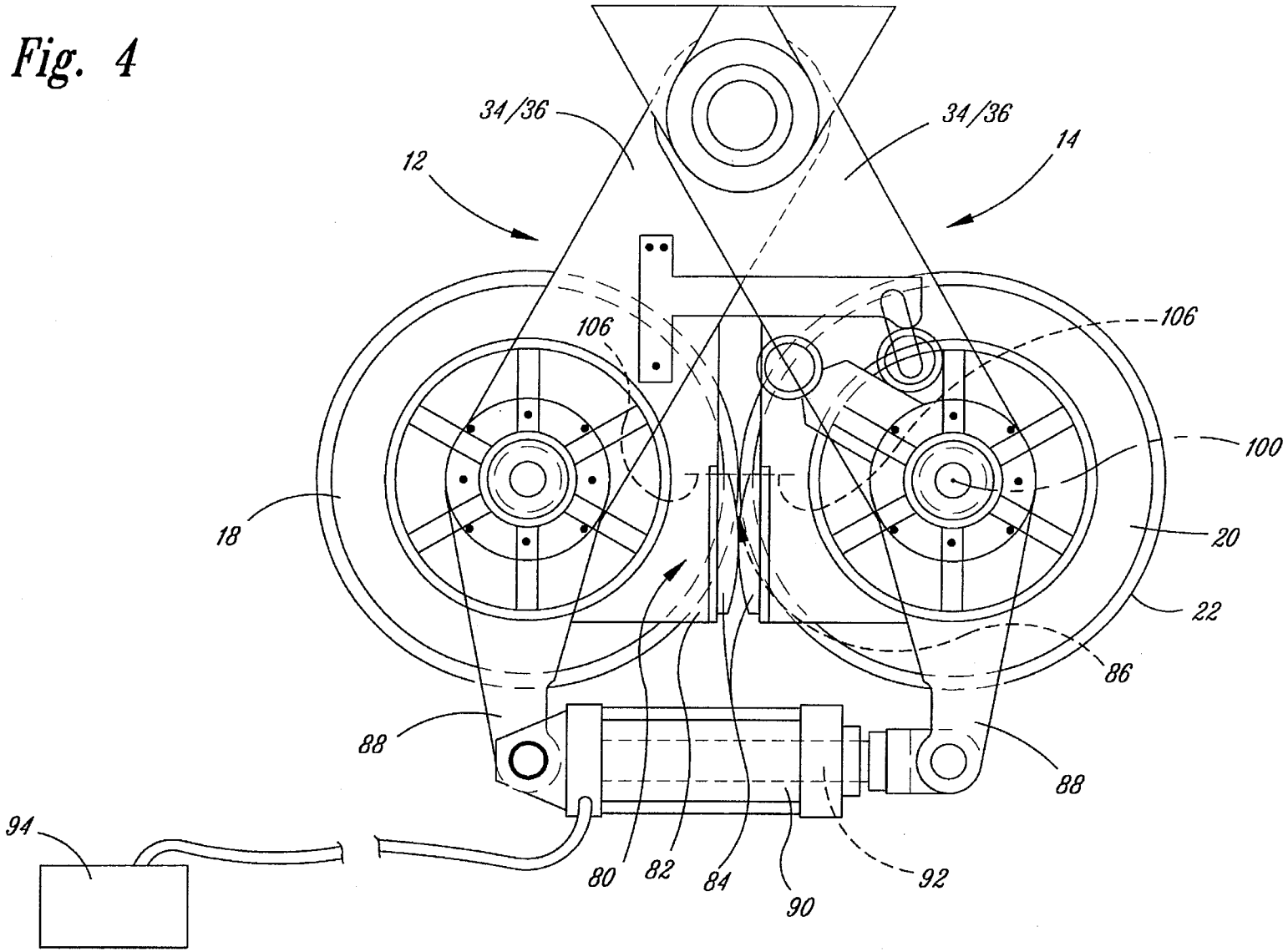
FIG. 4 is a rear elevation view of the destructuring machine shown in FIG. 2 illustrating a hydraulic cylinder and travel stops coupled to the pivot arms.

As best seen in FIGS. 2 and 4, each swing arm 34 and 36 includes a stop 80 having a support member 82 connected to the inside edge of the respective swing arm and a stop pad 84 on the inside edge of the support member. The stop pads 84 on the swing arms 34 and 36 of one swing assembly 14 are positioned to engage the stop pads on the opposing swing arm of the other swing assembly 16 when the swing assemblies are in the active position, thereby defining a minimum nip 86 between the opposing rollers 18 and 20 and preventing the rollers from contacting each other. The size of the nip 86 can be adjusted by increasing or decreasing the width of the opposing stop pads 84 or by adding, as an example, shims between the stop pad and the respective support member 82.

In the preferred embodiment, the size of the nip 86 depends upon the size and type of the chips being destructured. The nip 86 has a width that is smaller than the width of the chips 24 such that, as the chips are drawn downwardly between the rollers 18 and 20 and through the nip, the rollers exert a compressive force on the chip and deform the chip, as discussed in detail below, so as to create fissures in the chip. If large chips 24 are passed through the chip processing machine 10 and the chips will not sufficiently deform under the compression forces generated by the swing assemblies 12 and 14 so as to fit through the minimum width nip, then each of the swing assemblies will move away from each other while exerting the compressive forces on the chips until the chips have been destructured and passed through the nip 86 and between the rollers 18 and 20. Thereafter, the swing assemblies 12 and 14 are drawn back toward the active position, and the stop pads 84 prevent the swing assemblies from bouncing back toward the active position and moving past the minimum nip opening.

Such movement of the two swing assemblies 12 and 14 in opposite directions requires each swing assembly to move one-half the distance needed to provide the required spacing at the nip 86. The movement of the swing assemblies 12 and 14 and the respective rollers 18 and 20 requires about one-half of the time that is needed if only one roller were to be moved to increase the spacing at the nip. Therefore, the chip destructuring machine 10 is highly responsive and can be used at higher speeds in order to destructure and fissure the chips.

As best seen in FIGS. 2 and 4, one roller pressure cylinder 38 extends between and connects the lower portion 88 of the adjacent swing arms 34 and 36 at each end of the swing assemblies 12 and 14. Each roller pressure cylinder 38 is pivotally attached to the lower portions, such that movement of either or both of the swing arms 34 and 36 about the swing axis 26 is resisted by the roller pressure cylinder. In the preferred embodiment, each roller pressure cylinder 38 is a hydraulic cylinder that provides a biasing force that yieldingly urges the rollers 18 and 20 toward one another and toward the active position. The roller pressure cylinders 38 pull the rollers 18 and 20 toward each other until the opposing stops 80 engage each other and prevent further inward movement. The biasing force of the roller pressure cylinders 38 can be overcome and the rollers 18 and 20 will move apart from each other when a sufficient outward force is exerted on the rollers. After the outward force ceases, the roller pressure cylinders 38 pull the rollers 18 and 20 toward each other to the active position.

Each roller pressure cylinder 38 includes a cylinder body 90 and a rod 92. The cylinder body 90 is attached to the lower portion 88 of the swing arms 34 and 36 of one swing assembly 12 and the actuator rod 92 is attached to the lower portion of the opposing swing arm of the other swing assembly 14. One of the roller pressure cylinders 38 is coupled to a pressurized gas source 94 (FIG. 4), and the pressurized gas is used to load the respective roller pressure cylinder to control the biasing force and the resulting compression exerted by the rollers 18 and 20 during a destructuring process. The pressurized gas is also used to hold the swing assemblies 12 and 14 in the inactive position with the rollers 18 and 20 apart from each other, for example, for the set up or maintenance of the chip processing machine 10. Although the preferred embodiment utilizes a hydraulic cylinder configuration, a pneumatic cylinder, a spring arrangement, or other biasing mechanism can be used to yielding urge the rollers toward each other by pulling inwardly on the lower portions 88 of the adjacent swing arms 34 and 36.

The biasing inward force from the roller pressure cylinders 38 is combined with the inward forces, generated by gravity acting on the dead weight of the rollers 18 and 20 supported by the swing arms 34 and 36. Accordingly, the swing arms 34 and 36 act as level arms supporting the weight of the rollers 18 and 20, and gravity acts on the rollers to try to move them downwardly and inwardly to a position below the swing axis 26. The result is substantial compressive forces that are generated during a destructuring process at the nip 86 between the rollers 18 and 20 because of the leverage in the swing assemblies 12 and 16 in combination with the biasing force of the roller pressure cylinders 38.

Figure 5:
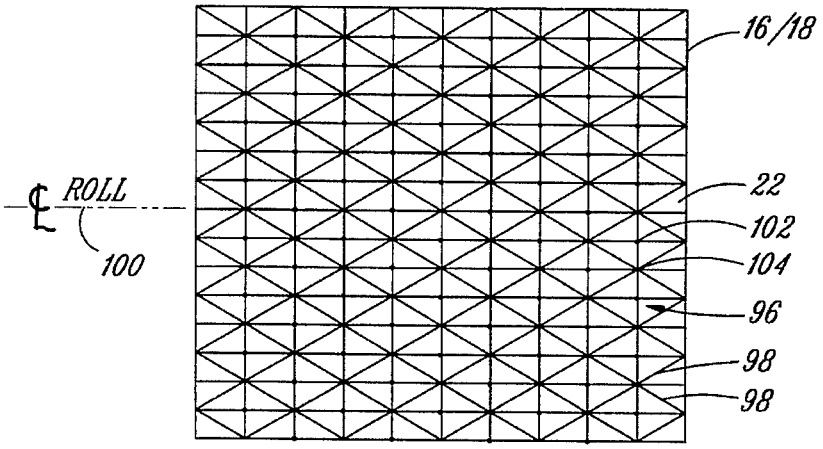
FIG. 5 is an enlarged side elevation view of the diamond pattern surface of the rollers shown in FIG. 1.
Figure 6:
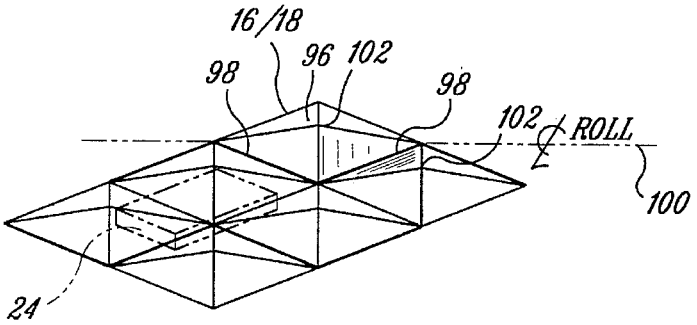
FIG. 6 is an enlarged isometric view of the diamond pattern surface of FIG. 5.

The compressive forces are exerted on the chips 24 passing through the nip 86 during the destructuring process by the destructuring outer surface 22 of the rollers 18 and 20. As best seen in FIGS. 5 and 6, the destructuring outer surface 22 of each roller 18 and 20 includes a plurality of the diamond-shaped protuberances 96 formed by a plurality of criss-crossing V-shaped grooves 98 that extend helically around the roller. Accordingly, none of the grooves 98 are parallel with the axis of rotation 100 of the roller. Each of the diamond-shaped protuberances 96 defined by the V-shaped criss-crossing grooves 98 has an upper peak 102, and a juncture area 104 is formed between four adjacent protuberances at the intersection of the criss-crossing V-shaped grooves 98.

As an example of the construction of the destructuring outer surface 22, the criss-crossing V-shaped grooves 98 of the preferred embodiment are angled relative to the roller's axis of rotation at approximately +27 degrees thereby defining the diamond-shaped protuberances 96 with length, width, and height dimensions. Adjacent, parallel V-shaped grooves 98 are spaced approximately 0.375 inches apart such that the length of each diamond-shaped protuberance 96 is approximately 0.826 inches and the width is approximately 0.421 inches. The preferred height of each diamond-shaped protuberance 96 from the peak 102 to the juncture area 104 is approximately 0.108 inches. In an alternate embodiment, the height is approximately, one-third of the smaller dimension of the length or width. The above-identified dimensions are provide for illustrative purposes, and the criss-crossing V-shaped grooves 98 and the resulting diamond-shaped protuberances 96 can be formed having other angular orientations and other dimensions. Thus, the present invention is not limited to the above-identified dimensions, ratios, or angles.

Figure 7:
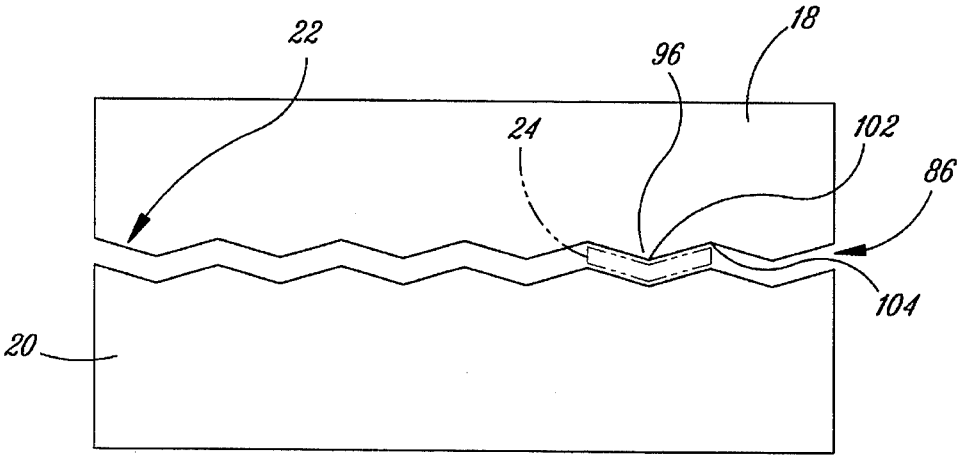
FIG. 7 is an enlarged cross-sectional view taken substantially along the line 7—7 of FIG. 2 showing the intermeshing arrangement of the diamond pattern surfaces of the adjacent rollers.

As best seen in FIG. 7, the rollers 18 and 20 are supported adjacent to each other with the nip 86 therebetween. The rollers 18 and 20 are positioned adjacent to each other such that the peaks 102 or the diamond-shaped protuberances 96 on each of the rollers are positioned opposite the juncture areas 104 on the respective opposing roller. The distance between the peak 102 on one roller 18 and an opposite juncture area 104 on the other roller 20 defines the size of the nip 86 through which the chips 24, shown in phantom lines, are forced. Accordingly, the destructuring outer surfaces 32 of the rollers 18 and 20 intermesh at the nip 86.

The clearance between the intermeshing rollers 18 and 20 at the nip 86 is less than the nominal thickness of the chips 24 being destructured so that the chips moving through the nip will be compressed between the protuberances 96 and the opposite juncture areas 104 so as to create fissures in the chips. As best seen in FIGS. 6 and 7, diamond-shaped protuberances 96 are sized such that four adjacent protuberances will engage and support one side of the chip 24, shown in phantom, above a juncture area 104 between the protuberances, and the peak 102 of the protuberance opposite the juncture area engages the opposite side of the chip. The peak 102 presses the middle portion of the chip 24 downwardly toward the juncture area 104 while the edges of the chip remain on the sides of the protuberances 96, thereby compressing and deforming the chip to create the fissures in the chip. Accordingly, at least four points of support are provided for a nominally sized chip 24 on the surface of one roller 18 with the single peak 102 on the opposite roller 20 providing a point load at approximately the center of the four points of support.

The diamond-shaped protuberances 96 provide a wedge-like contact with the chip 24 to encourage fissuring or separation of the long fibers. The peaks 102 of the diamond-shaped protuberances 96 hold the chips 24 as the rollers 18 and 20 move the chip through the nip 86 during the destructuring process. The diamond-shaped protuberances 96 have a surface area such that when the chip 24 is pressed by the peak 102 downwardly into the juncture area 104 of the opposite roller, the chip is put under compressive pressure to follow the contour of the destructuring outer surfaces, whereby the chip is caused to deform and bend.

The height of the diamond-shaped protuberances 96 and the alignment of the peaks 102 opposite the juncture areas 104 cause bending stresses in the chip 24 that are in excess of the breaking strength perpendicular to the grain and are below the flexural strength along the grain of the chip. Accordingly, fissures generally aligned with the grain are created in the chip 24 without the chip being broken into smaller pieces. The fissures are created in the chip, increasing the effective surface area of the destructured chip, for example, to increase the effectiveness of a chemical bath or the like when the destructured chips are used in the pulping process.

In an alternate embodiment of the present invention, the destructuring surface of the rollers 18 and 20 are smooth surfaces and the swing assemblies, in combination with the roller pressure cylinders 38, exert compression forces on the chips 18 being destructured. The compression forces generated by the smooth rollers to destructure the chips are in a range that is greater than the range of compression forces generated in the illustrated embodiment having the diamond-shaped protuberances on the destructuring surfaces. The smooth surface rollers of this alternate embodiment exert compression forces on the chip that create fissures in the chip but do not break the chips. The range of compression forces depend upon the size and type of the chips being destructured.

In another alternate embodiment, one of the rollers has a smooth destructuring surface and the destructuring surface of the other roller has the plurality of diamond-shaped protuberances discussed above. This embodiment having a combination of one smooth roller surface and one diamond patterned roller surface also exerts compression forces that are within a predetermined range to create fissures in the chips without breaking the chips. The range of compression forces depends upon the size and type of chip being destructured.

As best seen in FIG. 4, each of the rollers 18 and 20 has an alignment marker 106 used to align the opposing rollers to obtain a proper intermesh between the peaks 102 and juncture areas 104 of the destructuring outer surfaces 22. When the markers 106 on the rollers 18 and 20, are aligned with each other, the peaks 102 of the rollers 18 and 20 are directly opposite the juncture areas 104 in the respective opposing roller, thereby providing proper alignment of the rollers for the destructuring process. Before beginning the destructure process, the rollers 18 and 20 are held apart in an inactive position, and rotated so the alignment markers 106 are in approximate alignment. Thereafter the rollers 18 and 20 are moved to the active position with the destructuring outer surfaces 22 aligned for the selected destructuring process.

The preferred destructuring outer surface 22 of the rollers 18 and 20 are substantially identical so the destructuring outer surfaces will intermesh when the swing assemblies 12 and 14 are in the active position and the rollers 18 and 20 are rotated about their respective axes of rotation 100. When the swing assemblies 12 and 14 are in the active position and the alignment markers 106 properly aligned, the rollers 19 and 20 are rotated in opposite directions at the same rotational speed, as discussed in greater detail below, to ensure the opposing peaks 102 and juncture areas 104 will remain aligned in an intermeshed arrangement during the destructuring process.

Figure 8:
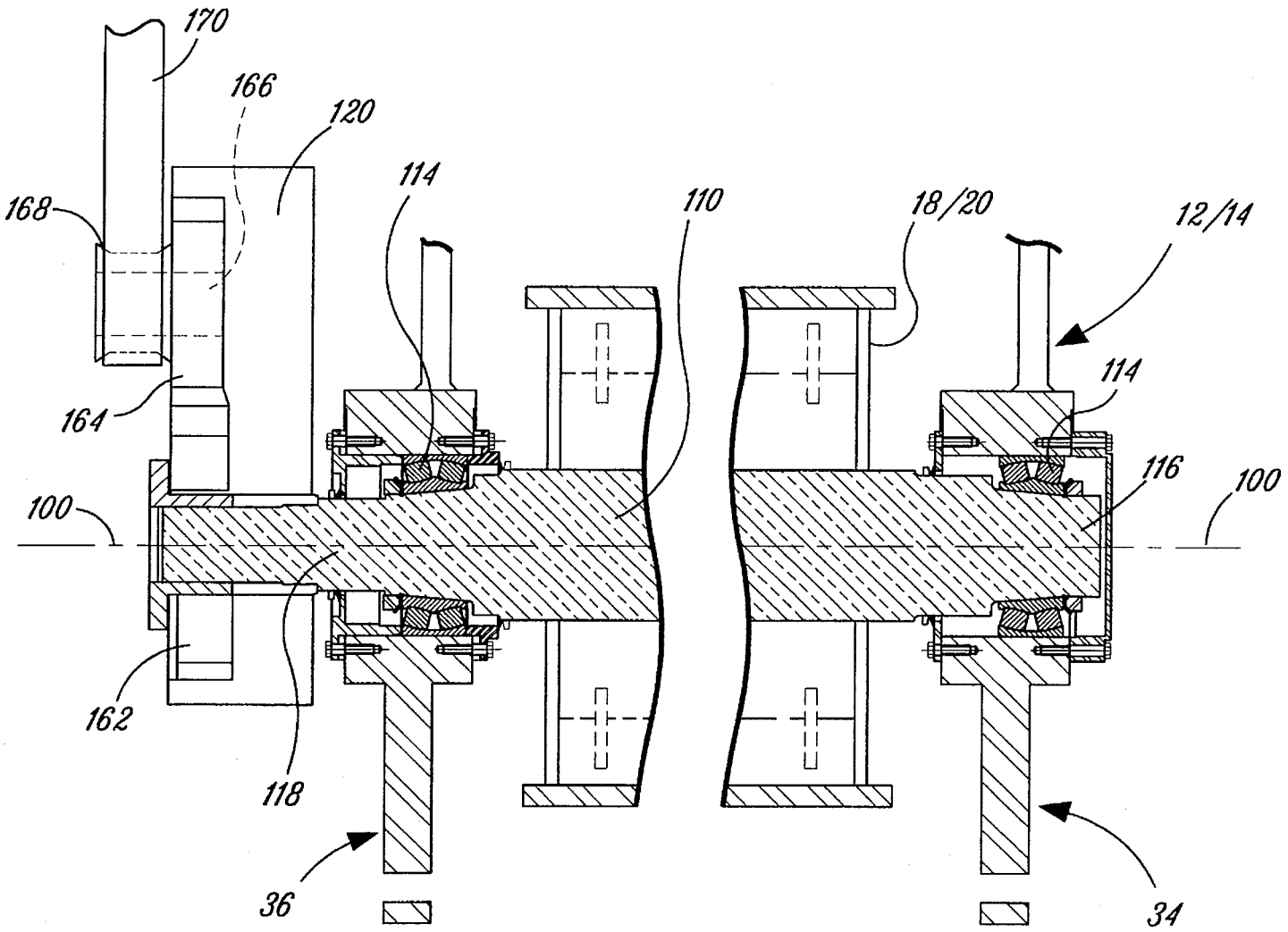
FIG. 8 is a cross-sectional view taken substantially along the line 8—8 of FIG. 2 showing the roller rotatably carried by the pivot arms.

As best seen in FIG. 8, the destructuring outer surface 22 of each of the rollers 18 and 20 is disposed about a central shaft 110 that is coaxially aligned with the roller's axis of rotation 100. The central shaft 110 extends between the swing arms 34 and 36 of the respective swing assembly 12 and 14. Outer end portions of the shaft 110 extend beyond the destructuring outer surface 22 and are rotatably carried by coaxially aligned spherical bearings 114 mounted in the swing arms 34 and 36. The shaft 110 is carried in a substantially horizontal orientation and parallel with the shaft of the outer roller and with the swing axis. The shaft 110 includes a stepped, non-driving end 116 in the one swing arm 34 and a stepped, driving end 118 that extends through the bearing 114 and through the other swing arm 36. The stepped portions of the driving and non-driving ends 118 and 116 94 are provided to fit into the bearings 114 and to define shoulders adjacent to the bearings that prevent lateral travel of the rollers 34 and 36 during rotation. The driving end 118 of the shaft 110 extends away from the swing arm 36 and is securely and operatively connected to reducing gearbox 120 that is coupled to the drive motor 28 (FIG. 1). As discussed in greater detail below, each of the reducing gearboxes 120 is constructed to rotationally drive the respective drive end 118 of the shaft 110 so as to rotate the shall about the axis of rotation 100 at a selected rotational speed.

Figure 9:
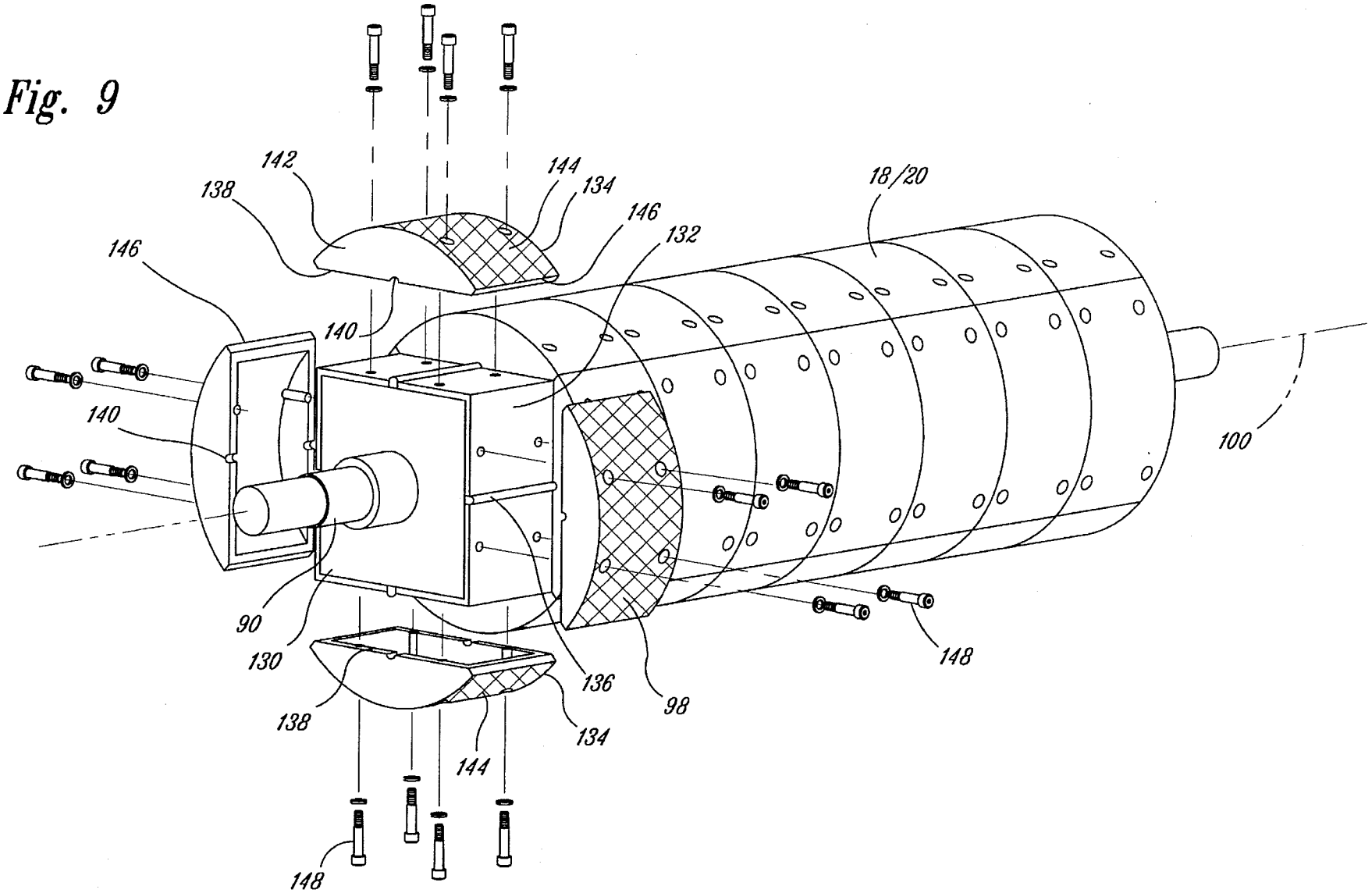
FIG. 9 is a partially exploded enlarged isometric view of a roller of FIG. 1 shown removed from the destructuring machine for purposes of clarity.

As best seen in FIG. 9, each of the rollers 18 and 20 includes a support core 130 attached to the shaft 110. The support core 130 has a square cross-sectional shape and four elongated support faces 132. The support faces 132 removably receive a plurality of curved outer roller segments 134 that define the cylindrical shape of the roller. Each of the support faces 132 has a protruding key member 136 positioned along the center line of the support face for aligning the curved segments 134 on the support face. Each of the curved segments 134 has a flat bottom side 128 having approximately the same width as a respective support face 132. The flat bottom side 138 has a keyway 140 formed therein that removably receives the key member 136 to align the curved segment 134 on the support core 130. The curved segment 134 has parallel side plates 142 that extend away from the flat bottom side 140 and support a curved face plate 144. The curved face plate 144 is sized to define one-fourth of the outer rolling surface of the roller, such that when four curved segments 134 are attached around a section of the support core 130, the four curved face plates form a round, continuous surface around the roller 18 or 20.

The ends of the curved face plate 144 of each curved segment 134 is connected to the flat bottom side 138 by beveled panels 146 that are at approximately a 45 degree angle relative to the flat side. When two curved segments 134 are attached to the support core 130 in a radially adjacent orientation, the adjacent beveled panels 146 are positioned parallel and immediately next to each other, such that the ends of curved face plates 144 of the curved segments form a continuous curved surface.

The curved face plate 144 of each curved segment 134 includes the plurality of criss-crossing V-shaped grooves 98 formed therein, such as by casting, machining, or the like. The curved face plates 144 are constructed such that each of the V-shaped grooves 98 on curved face plate aligns with the grooves in each of the adjacent curved face plates. Accordingly, the plurality of curved segments 134 are attached to the support core 130 to define the outer round surface of the entire roller, and the criss-crossing V-shaped grooves 98 on the curved face plates 144 interconnect to define the plurality of grooves that extend helically around the outer surface of the roller. Each of the curved segments 134 are removably retained on the support core 130 by a plurality of fasteners 148 such that the curved segments can be removed from the support core and replaced quickly and easily. When a surface portion of the roller 18 or 20 is subject to excessive wear or damage, or if a different dimension of diamond-shaped protuberances is desired on the rollers, such a change can be readily accomplished by replacing the curved segments 134 without having to replace the support core and without having to remove the support core from the swing arms 34 and 36.

Figure 10:
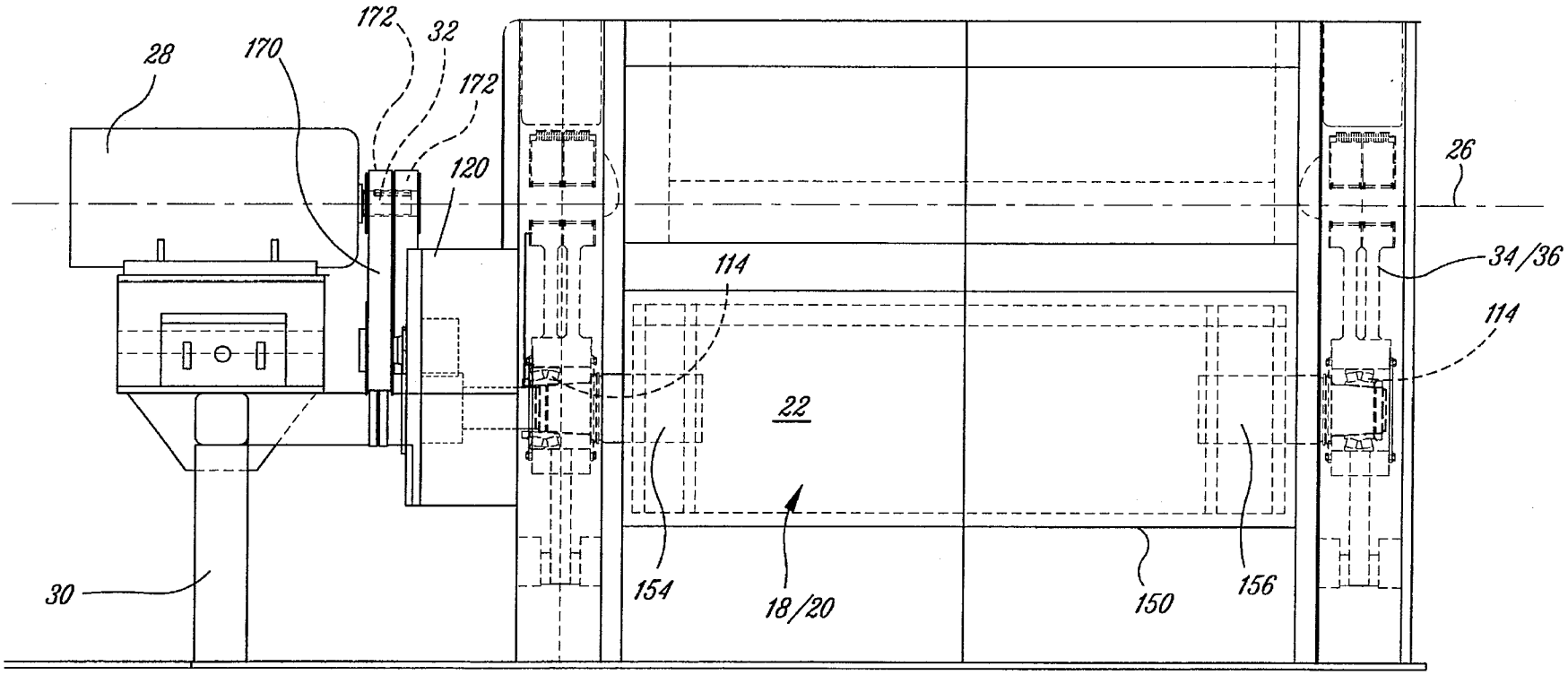
FIG. 10 is an enlarged side elevation view of the destructuring machine of FIG. 1 with an alternate embodiment of a roller.

In an alternate embodiment illustrated in FIG. 10, the rollers 18 and 20 are constructed with an elongated outer, cylindrical roll 150 that includes the criss-crossing, V-shaped grooves formed therein to define the destructuring outer surface 22. A pair of end caps 152 interconnect the cylindrical roll 150 to coaxially aligned driving and non-driving shall segments 154 and 156 that are rotatably carried by the bearings 114 in the same manner as the shaft 110 discussed above.

As best seen in FIG. 8, the shaft 110 of each roller 18 and 20 is rotatably connected at its driving end 118 to the reducing gearbox 120. The reducing gearbox 120 includes a housing 160 containing a first gear 162 fixed to the shaft's driving end 118 and a second gear 164 coupled to the first gear. The first and second gears 162 and 164 are coupled together such that rotation of the second gear causes the first gear and the attached shaft 110 to rotate about the axis of rotation 100.

The second gear 164 has a gear shaft 166 extending out of the housing 160 away from the roller 18 or 20 and a drive pulley 168 is fixed to the gear shaft exterior of the housing. The drive pulley 168 is shaped and sized to receive and retain an endless timing belt 170 extending to the drive motor 28 (FIG. 1). Accordingly, when the drive motor 28 moves the timing belt 170, the timing belt spins the drive pulley 168 and gear shaft 166, which spins the second and first gears 164 and 162, thereby rotating the shaft 110 and thus the roller 18 or 20 at a selected speed about the axis of rotation 100.

As best seen in FIG. 10, each roller 18 and 20 is connected to a respective reducing gearbox 120, so a timing belt 170 from each reducing gearbox is connected to the drive shaft 32 of the drive motor 28. A separate pulley 172 is fixed to the drive motor's drive shaft 32 for each of the two timing belts 170 that interconnect the drive motor 28 to the reducing gearboxes 120. Accordingly, the single drive motor 28 via the timing belts 170 spins the gears in the reducing gearboxes 120, thereby simultaneously during both of the rollers 18 and 20. Each of the reducing gearboxes 120 has the same reduction ration, such that both of the rollers 18 and 20 are driven at the same rotational speed. The speed of the rollers 18 and 20 is controlled by adjusting the rotational speed of the drive motor 28.

The drive shaft 32 and the reducing gearboxes 120 on the rollers 18 and 20 are configured such that the reducing gearbox on one roller rotates that roller at the selected rotational speed in one direction. The reducing gearbox 120 on the other roller is constructed to rotate that other roller 17 at the same rotational speed but in the opposite direction. In the preferred embodiment, one of the reducing gearboxes 120 is a double reduction gearbox using the two gears 162 and 104 to result in a predetermined gearing ratio. The other reducing gearbox is a triple reduction gearbox using a third gear 174, illustrated in FIG. 2, between the first and second gears 162 and 164. Accordingly, the combination of the three gears have the same gearing ratio as the other reducing gear box, and they rotate the other roller 20 at the same rotational speed and in the opposite direction from the first roller 18. Although the preferred embodiment uses double and triple reduction gearboxes, other configurations can be used, such as one gearbox containing an idler that results in opposite rotation of the roller. However, the rotational speed of the two rollers 18 and 20 remains the same to ensure the alignment of the outer destructuring surfaces 19 is maintained.

The drive shaft 32 and the pulleys 172 of the drive motor 28 are coaxially aligned with a swing axis 26. When the swing assemblies 12 and 14 are pivoted to and from the active position about the swing axis 26, such as during a chip destructuring process, the distance between the drive shaft 32 and the drive pulleys 168 of the reducing gearboxes 120 does not change. Therefore, movement of the swing assemblies 12 and 14 does not result in slack or increased tension generated in the timing belts 170, and the timing belts will continue to drive the rollers 18 and 20 at the same rotational speed. Such an arrangement allows the chip destructuring machine 10 to be used to destructure chips 24 having various sizes, and when the larger chips are squeezed between the rollers 18 and 20 and the swing assemblies 12 and 14 must move outwardly away from each other in order to pass the chips between the rollers. The swing assemblies 12 and 14 will pivot without having a detrimental effect on the rotational speed and the alignment of the rotating rollers 18 and 20. During such movement of the swing assemblies 12 and 14, the compression forces on the chips 24 are maintained, thereby ensuring the diamond-patterned destructuring surface will create fissures in the chips.

Figure 11:
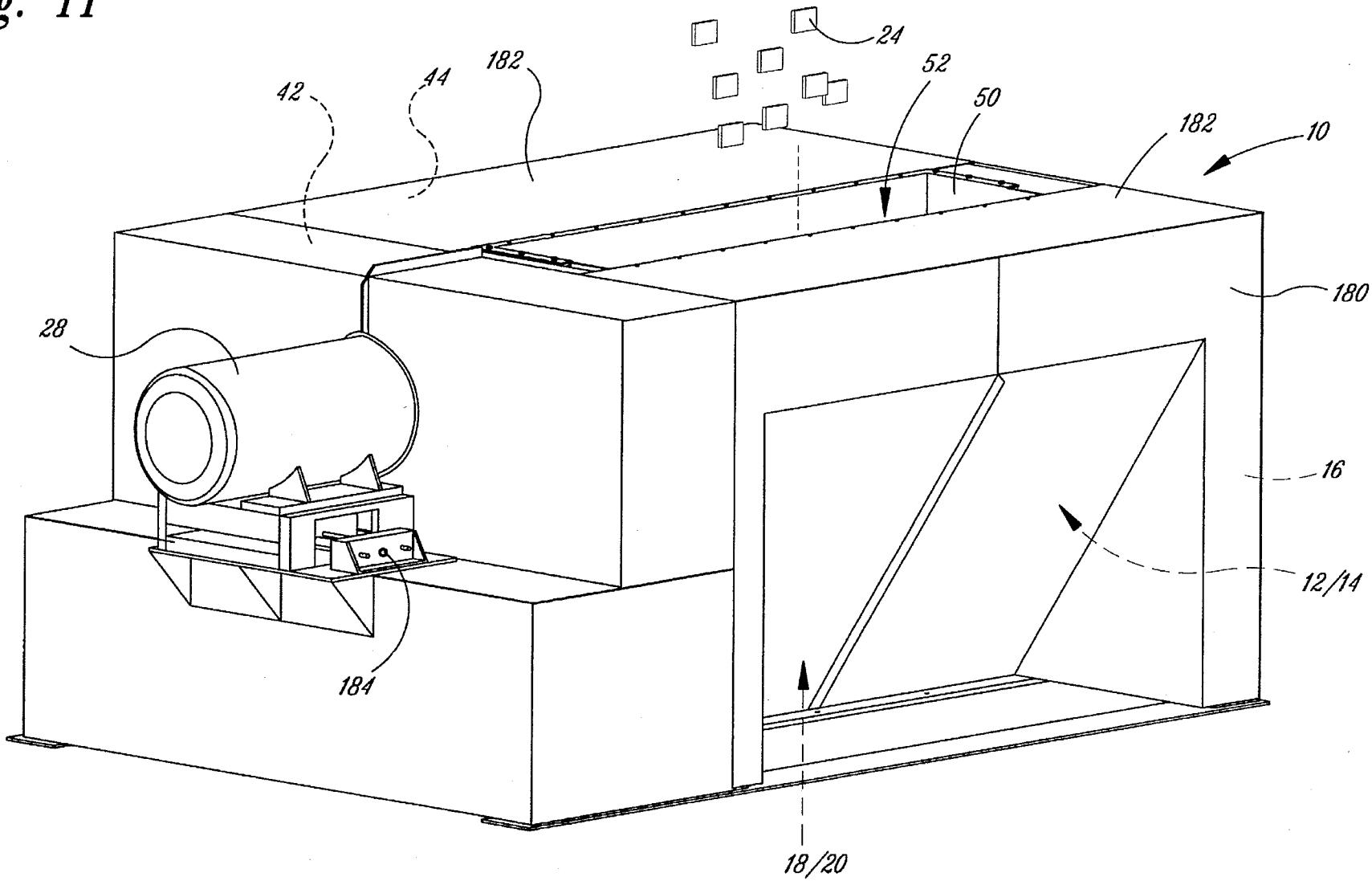
FIG. 11 is an isometric view of the chip structuring machine with an enclosure connected to the frame and surrounding the swing assemblies.

As best seen in FIG. 11, the chip destructuring machine 10 of the present invention includes a plurality of side panels 180 secured to the support frame 16 to form an enclosure around the swing assemblies 12 and 14. Top panels 182 are secured to the support frame 16 to close out the area between the horizontal beams 42, the horizontal cross braces 44, and the chute assembly 50. Accordingly, access into the interior area from the top of the chip processing machines is through the chute assembly 50, and the chips 24 must pass through the upper opening 62 in the chute assembly before dropping onto the rollers 18 and 20. The side panels 180 and the top panels 182 are removably fastened to the support frame such that selected panels may be removed, for example, for maintenance or cleaning of the chip structuring machine 10.

The drive motor 28 is exterior of the side panels 180 and top panels 182 and controls 184 of the motor as accessible from the exterior of the chip processing machine 10. In an alternate embodiment, the drive motor is also shrouded by panels. The motor may be controlled by conventional wire or wireless controls. The bottom of the support frame below the swing assemblies remains open such that the destructured chips or fissured chips can drop away from the destructuring machine and into a collection area or onto a conveyor for subsequent removal.

In an alternate embodiment of the invention not illustrated, the rollers 18 and 20 are driven at the same rotational speed by the single drive motor 28 having a single pulley that receives a single endless timing belt. The single endless timing belt extends away from the pulley and forms a loop around each of the drive pulleys 168 on the reducing gearboxes 120, and around an idler pulley directly below the pulley on the drive shaft 32. Accordingly, the single endless timing belt spins both of the drive pulleys of the reducing gearboxes to drive both of the rollers at the same rotation speed. In this alternate embodiment, the drive shaft single drive motor is aligned with the swing axis of the swing assemblies.

In another alternate embodiment, not illustrated, the rollers are driven by a single drive motor that is coupled to an input shaft of a gear box, and the gearbox has a pair of output shafts that rotate in opposite directions. Each of the output shafts is connected to a respective roller by a shall having universal joints or other flexible coupling devices to connect the shaft between the gearbox and the roller. In another embodiment, not illustrated, the rollers are driven by separate drive motors that are synchronized so as to drive the two rollers at the same rotational speed. In another embodiment, not illustrated, a single drive motor is utilized and coupled to the gear reducer by a pair of intermeshing gears with extended teeth thereon that allow for movement of the swing assemblies between the active and inactive positions to drive the rollers.

Although the preferred embodiment discussed above and the alternate embodiment discuss the drive motors being coupled to the reducing gearboxes and/or rollers by a timing belt, other drive belts or drive chains may be utilized. Further, other suitable connection devices or techniques can be used to transmit the rotational movement generated by the drive motor to the gearbox so as to rotate the rollers.

While various embodiments of the chip destructuring machine in accordance with the present invention have been described herein for illustrative purposes, the claims are not limited to the embodiments described herein. Equivalent devices may be substituted for those described, which operate according to the principles of the present invention and thus fall within the scope of the following claims. Therefore, it is expressly to be understood that the modifications and variations made to the chip destructuring machine of the present invention may be practiced while remaining within the spirit and the scope of the invention as defined in the following claims.

We claim:

1. A chip processing machine comprising:

a support frame providing a single swing axis;

two swing assemblies providing parallel side-by-side squeeze rollers, said swing assemblies being swing-mounted on said frame to swing said rollers toward and away from one another on said swing axis between active and inactive positions;

a drive shaft having a rotation axis aligned with said swing axis;

drive assemblies from said drive shaft to said rollers for rotating the rollers in opposite directions at the same rotational speed;

co-acting stops on said swing assemblies for defining the spacing between said rollers when they are in active squeezing position;

a biasing mechanism yieldingly urging said rollers toward one another into active position with said stops in engagement with one another; and a chute for guiding chips to said rollers to be squeezed therebetween.

2. A chip processing machine according to claim 1 in which said rollers have matching protuberances for fissuring chips passing between the rollers.

3. A chip processing machine according to claim 2 in which said protuberances are formed on each roller by sets of criss-crossing grooves, none of which are parallel with the rotation axis of the roller.

4. A chip processing machine according to claim 1 in which elastic pads are arranged between said support frame and said swing assemblies such that said pads are compressed when said rollers are in active position.

5. A chip processing machine according to claim 1 in which said stops are adjustable to adjust the spacing between said rollers at said active position.

6. A chip processing machine according to claim 1 in which said drive assemblies each comprise a gearbox mounted on the respective swing assembly and having an output shaft connected to the respective roller, each said gearbox having an input shaft coupled by a respective flexible drive from said drive shaft.

7. A chip processing machine according to claim 6 in which each said flexible drive comprises pulleys on said drive shaft and the respective said input shaft, and a timing belt between said pulleys.

8. A chip processing machine according to claim 6 in which one of said gearboxes has an idler gear between its input and output shafts whereby its output shaft turns oppositely from the output shaft of the other gearbox.

9. A chip processing machine according to claim 1 in which each of said swing assemblies comprises two swing arms each swing-mounted at said swing axis adjacent an upper end and providing a bearing for the respective roller adjacent a lower end.

10. A chip processing machine according to claim 9 in which each of said swing assemblies comprises a shaft, a roller on the shall, and two swing arms at opposite ends of the roller and supporting the shaft by bearings, said swing arms being swing-mounted at said swing axis.

11. A chip processing machine according to claim 10 in which said biasing mechanism comprises two hydraulic cylinder units extending between adjacent swing arms of said swing assemblies, the hydraulic fluid at one end of said cylinder units being loaded by compressed gas when said rollers are in active position, said hydraulic units being operable to selectively swing said swing assemblies away from one another to responsively move said rollers into said inactive position.

12. A chip processing machine according to claim 9 in which elastic pads are arranged to be compressed between one end of said swing arms and said support frame when said stops are engaged.

13. A chip processing machine according to claim 1 wherein at least one of said rollers comprises a pair of shaft sections, a support core connected to the shaft sections, and a plurality of curved surface sections removably attached to said support core, said plurality of curved surface sections defining an outer destructuring surface of said roller for destructuring the chips.

14. A chip processing machine according to claim 1 in which each of said rollers have smooth outer surfaces for exerting elevated compressive force on said chips passing between said rollers to create fissures in said chips.

15. A chip processing machine according to claim 1 in which one of said rollers includes smooth outer destructuring surface and the second of said rollers include a plurality of destructuring protuberances for exerting compressive force on said chips passing between said rollers to create fissures in said chips, said destructuring protuberances being formed by sets of criss-crossing grooves, none of said criss-crossing grooves being parallel with the rotation axis of said second of said rollers.

16. A wood chip processing machine for destructuring similarly sized wood chips each having opposite faces separated by a thickness dimension, said machine comprising:

a pair of intermeshing rollers, each of the rollers having a destructuring surface defined by a knurled pattern formed by two like sets of equally spaced V-shaped grooves extending helically around the roller and criss-crossing each other at a plurality of junctures such as to form four-sided protrusions each having a peak, each of the plurality of junctures of the crisscrossing V-shaped grooves on each of the rollers being positioned opposite the peak of one of the protrusions on the other roll in the nip where the rolls intermesh, the clearance between the intermeshing rollers at the nip being less than the normal thickness dimension of the chips being processed so that the chips in the nip will be compressed and deformed to destructure the chips, said protrusions being of a size that four of the protrusions on one of said rollers will engage one of said opposite faces of a chip in said nip while a protrusion on the other roller between said four protrusions engages the other of the opposite faces of such chip for assisting in destructuring of the chip while in the nip;

a drive mechanism for turning said rollers on parallel axes at the same rotational speed;

swing arms rotatably carrying said rollers in a side-by-side relationship; and a frame pivotally supporting said swing arms, said swing arms being pivotal about a common swing axis.

17. The wood chip processing machine of claim 16, further comprising a blocking device coupled to the rollers and positioned to block the rollers from moving past a predetermined position relative to each other to define a minimum clearance between the rollers at the nip.

18. The wood chip processing machine of claim 16, further comprising a movement resistor coupled to the rollers that provides resistance to movement of the rollers away from each other.

19. The wood chip processing machine of claim 16 wherein the movement resistor is a hydraulic cylinder connected to the support arms.

20. The wood chip processing machine of claim 16 wherein at least one of the rollers includes a pair of shaft sections, a support core connected to the shaft sections, and a plurality of surface sections removably attached to the support core, the plurality of surface section defining the destructuring surface of the roller.

21. The wood chip processing machine of claim 16 wherein each of the rollers is coupled to the drive mechanism by a respective drive transmitting device, and the drive mechanism has a drive axis coaxially aligned with the single pivot axis.

22. The wood chip processing machine of claim 16, further comprising a pair of identically ratioed gear reducers, each of the gear reducers being connected to a respective one of the rolls, and each of the gear reducers being connected to the drive mechanism by a respective drive belt such that the drive mechanism simultaneously drives both drive belts and gear reducers for simultaneous rotations of the intermeshing rolls.

23. The wood chip processing machine of claim 16, further comprises a gear reducer connected to each of the rolls and coupled to the drive mechanism, each of said gear reducers is coupled to drive mechanism by a drive transmitting device.

24. A wood chip processing machine for destructuring similarly sized wood chips each normally having four-sided opposite faces separated by a thickness dimension, said machine comprising:

a pair of intermeshing like rolls;

a drive mechanism for turning said rolls on parallel axes at the same rotational speed;

each said roll having two crisscrossing like sets of equally spaced V-shaped grooves extending helically around the roll to define junctures at areas where the grooves criss-cross and to define a plurality of protrusions;

each juncture on each of said rolls being positioned opposite the peak of one of the protrusions on the other roll in a nip opening between the rolls where the rolls intermesh, the clearance between the rolls at the nip being less than the normal thickness dimension of the chips being processed so that the chips will be compressed and deformed to destructure the chips;

said protrusions being of a size that four of the protrusions on one of said rolls will normally engage one of said opposite faces of a chip in the nip while a protrusion on the other roll between said four protrusions engages the opposite face of such chip for assisting in destructuring of the chip while in the nip.

* * * * *